US005387351A

United States Patent [19]

Kumar et al.

[11] Patent Number: 5,387,351

[45] Date of Patent: Feb. 7, 1995

[54] LUBRICATING GREASE COMPOSITION AND PROCESS FOR PREPARING SAME

[76] Inventors: Anoop Kumar; Eltepu Sayanna; Amar S. Verma; Kanta P. Naithani; Madan M. Rai; Akhilesh K. Bhatnagar, all of c/o Indian Oil Corporation Limited, R&D Centre Sector 13, Faridabad (121007), India

[21] Appl. No.: 66,667

[22] Filed: May 25, 1993

[51] Int. Cl.[6] ..... C10M 129/06

[52] U.S. Cl. ..... 252/32; 252/35; 252/37; 252/37.2

[58] Field of Search ..... 252/32, 35, 37, 37.2

[56] References Cited

U.S. PATENT DOCUMENTS

| | | | |
|---|---|---|---|
| 4,839,068 | 6/1989 | Lange | 252/35 |
| 5,084,069 | 1/1992 | Farng et al. | 252/46.6 |
| 5,116,521 | 5/1992 | Fujii et al. | 252/37.2 |

FOREIGN PATENT DOCUMENTS

| | | | |
|---|---|---|---|
| 87/04454 | 7/1987 | WIPO | C10M 129/06 |

*Primary Examiner*—Stephen Kalafut
*Assistant Examiner*—James M. Silbermann
*Attorney, Agent, or Firm*—Kerkam, Stowell, Kondracki & Clarke; Edward J. Kondracki

[57] ABSTRACT

Lubricating grease compositions based on titanium complex soap thickener in mineral and synthetic base oils have been prepared for the first time. Tentative methods for preparing lubricating grease from this new type of titanium complex soap thickener have been described. High performance lubricating grease resulted from titanium terphthalate stearate complex soap thickener, exhibited excellent mechanical stability, high drop point, excellent oxidation stability, very good extreme pressure and antiwear properties, good water resistance and corrosion inhibiting characteristics.

10 Claims, No Drawings

LUBRICATING GREASE COMPOSITION AND PROCESS FOR PREPARING SAME

FIELD OF INVENTION

This invention relates to a high performance lubricating grease composition based on a completely new type of titanium complex soap thickener viz., titanium terephthalate stearate.

BACKGROUND OF THE INVENTION

Titanium metal component in complex soap thickener has been derived from titanium isopropoxide rather than an alkali. Several carboxylic acid and fatty acid combinations with titanium isopropoxide have been tried in order to get a lubricating grease of comparable performance characteristics with other high performance lubricating greases, such as, lithium complex, aluminum complex, sulfonate complex or polyurea greases. The best emerged combination, terephthalate stearate complex soap in mineral base stock, exhibited comparable, if not better, performance characteristics to the other above mentioned high performance lubricating greases.

PRIOR ART

In the prior art, metallic soaps and their complex soaps have generally been used as thickeners in lubricating grease industry. The continuous large scale usage of these type of thickeners in grease formulations is perhaps due to their excellent thickening capacity, easy availability and cost factors. Most of these commercially applicable metallic or complex metallic soap thickeners are derived from metals such as lithium, calcium, sodium, barium, aluminium etc., and are well known in the art. With few exceptions, metallic soaps other than mentioned previously constitute a minor portion of thickeners in lubricating greases. In fact, in most cases soaps of miscellaneous metals serve some functions other than that of thickeners.

However, in earlier stages C. J. Boner in Ind. Eng. Chem. 29.59(1937) has mentioned the preparation of soaps of Cd, Ce, Mg, Cr, Co, Hg, Sn in an attempt to prepare lubricating grease. Nevertheless, in the course of time these soaps have not gained commercial significance in lubricating greases.

Similarly, U.S. Pat. No. 2,878,236 describes titanium stearate used as a polymerisation catalyst. Another publication (Klarkes Markley's fatty acid part-II, Inc. N.Y. 1961, P. 717) on titanium stearate provided the melting point of titanium sterate soap as 62° C. Therefore, perhaps because of having a low melting point of these titanium soaps have not been used as thickeners in lubricating greases. Complex soaps of titanium, however, have not been reported so far for lubricating grease purpose.

In commercial formulations of lithium and calcium complex soap base greases, metallic compounds used for their preparation are the oxides/hydroxides of respective metals. On the other hand, in aluminium complex soap based greases, the metallic component is derived from aluminium isopropoxide in place of an alkali (NLGI July 1965) and these greases are gaining increased commercial applications. Interestingly, alkoxide/isopropxide of several other metals are also well known in prior art (Bradley, D. C. et.al in "Progress in Ing. Chem. Vol.II Interscience P. 303 (1960), J. Chem. Soc, 2027, 1952 and 2025, 1953). In recent years, reactive alkoxides of titanium have become commercially available at attractive prices. This is because of wide spread abundance of Ti metal in the earth's crust (The Wealth of India, Industrial Products Part VIII CSIR,1973). Fully substituted alkoxides of titanium are prepared by melles process. Reaction of monohydric alcohol with titanium tetrachloride is carried out in an inert solvent which may be a hydrocarbon or a chlorinated hydrocarbon and in presence of hydrochloric acid acceptor, such as sodium metal, ammonia and certain amines (U.S. Pat. No. 2,187,721 (1940), Brit., Patent No. 512452 (1939).

Hitherto, most soap or complex soap thickners of commercial significance for formulating lubricating greases are metals derived from either alkali or alkaline earth metals.

SUMMARY OF THE INVENTION

A primary object of this invention is to propose a novel lubricating grease composition capable of use as a lubricant for automotive and industrial applications.

Another object of this invention is to propose a novel lubricating grease composition having suitable mechanical and oxidation stability properties.

Still another object of this invention is to propose a novel lubricating grease composition having a high drop point and good EP and antiwear properties.

Yet another object of this invention is to propose a novel lubricating grease composition having good water resistance and corrosion inhibition characteristics.

A further object of this invention is to propose a process for the preparation of lubricating grease compositions having the aforesaid properties.

DETAILED DESCRIPTION OF PREFERRED EMBODIMENTS

In accordance with this invention the lubricating grease composition comprises 2 to 20% by weight of titanium alkoxide, 2 to 20% by weight of carboxylic acid, 5.0 to 35.0% by weight of fatty acids, 0.0 to 5.0% by weight of water and 20 to 90% by weight of mineral/synthetic oil.

In accordance with a preferred embodiment of this invention the lubricating grease composition 2 to 20% by weight of titanium alkoxide, 5 to 25% by weight of fatty acid, 2 to 20% by weight of carboxylic acid, 0.0 to 5.0% by weight of water and 20 to 90% by weight of mineral or synthetic oil.

Further according to this invention, there is provided a process for the preparation of a lubricating grease composition which comprises the steps of by forming in the first stage a mix by adding together fatty acid, carboxylic acid and mineral or synthetic oil in required proportions, stirring and heating such a mix to a temperature of 70° to 100° C., adding in the second stage titanium dioxide in the required proportions while maintaining said temperature, raising the temperature to 100° to 200° C. to form a thickened grease product, cooling said product, and in the third stage adding water thereto, if required, and then subjecting the mixture to the step of shearing.

In accordance with this invention, a vessel equipped with a stirrer capable of 0–150 rpm in the first stage, is charged with 5 to 35% by weight of fatty acid, 2 to 20% by weight of carboxylic acid and 20 to 90% by weight of mineral or synthetic oil, based on the total weight of the final grease composition.

The mixture is stirred and heat is provided through a heating mantle to reach the temperature to 70°-100° C. At the end of the first stage, 2 to 20% by weight of titanium alkoxide is added slowly based on the total weight of the final grease composition.

The mixture is continuously mixed and held at 70°-100° C. for 1-2 hours, temperature being raised very slowly to 100°-200° C., duration of maintaining at this temperature is 2-8 hours. During this period the product assumes grease structure and converts to a thickened mass. The product is then cooled with continuous stirring to 140°-100° C. at the end of this second stage, if desired up to 5% by weight of water is added to the mixture, based on the total weight of the final grease composition. The mixture is further cooled to 80°-60° C. and sheared with the help of a colloid mill. The resulting product of NLGT No. 1 to 5 is obtained.

It is, however, possible to combine the first and second stages to provide an alternate route.

Thus, according to this invention there is provided an alternate process for the preparation of a lubricating grease composition which comprises in preparing in the first stage a mix by adding together fatty acid, carboxylic acid, titanium alkoxide and mineral or synthetic oil in required proportions, heating such a mixture to a temperature of 160° to 200° C., cooling the resultant mix and in the second stage adding required water thereto, stirring the cooled mix and then further cooling said mix and subjecting it to the step of shearing.

In accordance with the alternate process of this invention, the charge is stirred with simultaneous heating through a heating mantle. The mixture is heated upto a temperature of 160°-200° C. in 2-8 hours. The resultant product is cooled to 140°-80° C. and water is added from 0.1 to 5.0%. This is further stirred for 5 minutes to 1 hour at this temperature and then further cooled to 80°-50° C. and sheared in a colloid mill. The resultant product of NLGT NO. 1-5 is obtained.

Titanium alkoxides used in present invention is preferably titanium alkoxide of C3 to C6 alcohol having titanium metal content of 17% by weight approximately and used in the amount 2-20% by weight of the final lubricating grease composition The synthetic hydrocarbon lubricating oil used in the compositions of present invention is an oligomer of olefin such as polyalpha olefins, polybutenes, polyethers, mineral base stocks are the neutral oils.

The sources of fatty acids employed in the grease composition are alkyl carboxylic acids from vegetable sources which may have few double bonds in the structure. For instance, it includes stearic acid, hydroxystearic acid, oleic acid, mahuwa oil, etc., and is present in an amount of 5 to 35% by weight of the final lubricating grease composition.

The carboxylic acids employed in this invention are, for example, mono-carboxylic acid ranging from acetic acid to BVC acid, C2 to C10 carbon chain dicarboxylic acids, hydroxydicarboxylic acids such as tartaric acid and citric acid, aromatic acids include both mono and di-carboxylic acids, as well as hydroxy mono carboxylic acid, for example, benzoic acid, salicyclic acid, phthalic acid, terepthalic acid, (Table I). Inclusion of inorganic acids like boric and phosphoric is also the illustration of present invention. This is present in an amount 2.0 to 20% by weight of the final lubricating grease.

In order to describe more fully the nature of the present invention, specific examples will hereinafter be described. It should be understood, however, that this is done solely by way of example and is intended neither to delineate nor limit the ambit of the appended claims.

EXAMPLE NO. 1

The lubricating grease composition has been prepared containing the ingredients with proportions indicated as described hereinbelow. and following the procedure as indicated above. Here fatty acid used is stearic acid 5.6% and titanium alkoxide is titanium tetraisopropoxide, 6.6%. Table No. 1 demostrates the various carboxylic acids 6.6% tried with a view of preparing lubricating grease.

TABLE NO. 1

| | Carboxylic acids used in the inventions | |
|---|---|---|
| S.No. | Carboxylic acid | Structure |
| 1. | Acetic acid | $CH_3COOH$ |
| 2. | B.V.C. acid | $CH_3(CH_2)_nCOOH$ |
| 3. | Oxalic acid | $(COOH)_2$ |
| 4. | Malonic acid | $CH_2(COOH)_2$ |
| 5. | Succinic acid | $(CH_2)_2(COOH)_2$ |
| 6. | Glutaric acid | $(CH)_3(COOH)_2$ |
| 7. | Azelaic acid | $(CH_2)_7(COOH)_2$ |
| 8. | Sebacic acid | $(CH_2)_8(COOH)_2$ |
| 9. | Tartaric acid | [CH(OH)COOH] |
| 10. | Citric acid | $C_1H_2COOH$ $C_1(OH)COOH$ $CH_2COOH$ |
| 11. | Benzoic acid | $C_6C_5COOH$ |
| 12. | Salicylic acid | $C_6H_4(CH)COOH$ |
| 13. | Phthalic acid (ortho benzene dicarboxylic acid) | $C_6H_4(COOH)_2$ |
| 14. | Terephthalic acid (para benzene dicarboxylic acid) | $C_6H_4(COOH)_2$ |
| 15. | Fumaric acid | $(CH\ COOH)_2$ |
| 16. | Maleic acid | $(CH\ COOH)_2$ |
| 17. | Cinnamicacid | $C_6H_5CH{=}CH{-}COOH$ |

Table No. 2 represents few physico chemical test data of some of the greases.

TABLE NO. 2

| S. NO. | CARBOXYLIC ACID USED | TOTAL FATTY MATERIAL IN % IN MINERAL OIL | DROP POINT D-566/ D-2265 C | WORKED PENETRAT AT 25 C. D-217 |
|---|---|---|---|---|
| 1. | GREASE NSA (Succinic Acid) | 27.2 | 232 | 305 |
| 2. | GREASE TTA (Tartaric Acid) | 28.6 | 220 | 281 |
| 3. | GREASE CTA (Citric Acid) | 30.8 | 215 | 278 |
| 4. | GREASE PTA (Phthalic Acid) | 25.4 | 250 | 181 |
| 5. | GREASE TPA (Terephthalic Acid) | 14.6 | 296 | 281 |

EXAMPLE NO. 2

The lubricating grease composition has been prepared by the method of Example No. 1 by adding 5.6 of commercially available titanium isopropoxide 6.6% of phthalic acid, 5.6% of stearic acid, the remainder being mineral base oil and water.

Lubricating grease was prepared by the method described above. Lubricating grease thus prepared exhibited physico-chemical characteristics indicated in Table-3.

TABLE NO. 3

| S. NO. | | ASTM/IP METHOD | RESULTS |
|---|---|---|---|
| 1. | PENETRATION AT 25° C. AFTER 60 STROKES | D-217 | 230 |
| 2. | DROP POINT °C. | D-566 | 249 |
| 3. | COPPER CORROSION AT 100° C. AFTER 24 HRS | TP-112 | PASS |
| 4. | RUST PREVENTIVE PROPERTIES | D-1743 | PASS |
| 5. | WATER WASHOUT % Wt. | D-1264 | 1.9 |
| 6. | ROLL STABILITY % CHANGE 2 HRS. | D-1831 | 8.0 |
| 7. | FOUR BALL BP TEST WELD LOAD KG. | IP-239 | 160 |
| 8. | FOUR BALL WEAR TEST 40 KG, 75° C. 1200 RPM & 1 HR WEAR SCAR DIA MM | D-2266 | 0.6 |

The effectiveness of the lubricating grease composition described above demonstrates its high drop point, good shear stability, good corrosion resistance, good chemical stability and good EP and antiwear properties.

EXAMPLE NO. 3

This example has a variation as synthetic hydrocarbon oil (PAO) was used in place of mineral oil, otherwise all other conditions and ingredients are the same as stated in Example No. 2.

The resultant grease exhibited the following physicochemical characteristics as indicated in Table No. 4.

TABLE NO. 4

| S. NO. | PROPERTY | TEST RESULTS |
|---|---|---|
| 1. | PENETRATION AT 25° C. 60 STROKES | 278 |
| 2. | DROP POINT °C | 262 |
| 3. | COPPER CORROSION | PASS |
| 4. | RUST PREVENTIVE PROPERTIES | PASS |
| 5. | WATER WASHOUT % WT. | 2.0 |

This example has demonstrated improved drop point, and good water resistance and good corrosion inhibition properties.

EXAMPLE NO. 4

This example illustrates the preparation of lubricating grease with ingredients in the proportions as indicated in Example No. 2 hereinabove. The polycarboxylic acid used is terephthalic acid and other ingredients are the same as titanium isopropoxide, stearic acid, mineral base oil and water.

The lubricating grease prepared as per described method and ingredients without any performance additive exhibited following physicochemical characteristics in Table No. 5.

TABLE NO. 5

| S. No. | PROPERTY | ASTM/IP METHOD | RESULTS |
|---|---|---|---|
| 1. | MECHANICAL STABILITY AT 25 C. | D-217 | |
| | AJ WORKED PENETRATION | | 254 |
| | BJ AFTER 100000 STROKES | | 271 |
| | CJ CHANGE FROM 60 STROKES | | +15 UNIT |
| 2. | DROP POINT °C. | D-566 | 258 |

TABLE NO. 5-continued

| S. No. | PROPERTY | ASTM/IP METHOD | RESULTS |
|---|---|---|---|
| 3. | OXIDATION STABILITY | D-942 | |
| | AJ AFTER 100 HRS | | 1 PSI DROP |
| | BJ AFTER 500 HRS | | 5 PSI DROP |
| 4. | WATER WASHOUT | D-1264 | 1.9% |
| 5. | LOSS ON EVAPORATION | D-972 | 0.6% |
| 6. | COPPER CORROSION AT 100 C. +/−5 C., 24 HRS | IP 112 | PASS |
| 7. | LOW TEMP. TORQUE AT −30 C. | IP 186 | |
| | AJ STARTING | | 3500 gmcm |
| | BJ RUNNING | | 500 gmcm |
| 8. | FOUR BALL EP TEST WELD LOAD KG | IP-239 | 280 |
| 9. | FOUR BALL WEAR TEST 40 KG, AT 15 C., 1200 ROM, 1 HR WEAT SCAR DIA, MM. | D-2266 | 0.4 MM |

The effectiveness of the lubricating grease composition described above demonstrates its high drop point, excellent shear stability, good corrosion resistance, excellent EP and antiwear properties, excellent oxidation stability which fulfils the objective to be a high performance lubricating grease capable of commercial applications.

EXAMPLE NO. 5

This example illustrates the preparation of lubricating grease with proportions indicated in Example 1. The polycarboxylic acid used is terephthalic acid, monocarboxylic acid is stearic acid, titanium alkoxide is titanium isopropoxide, mineral oil and water. The lubricating grease prepared as per the alternate method described earlier exhibited the following physicochemical characteristics as indicated in Table-6. In this alternate process, all ingredients in known quantities are taken simultaneously.

TABLE NO. 6

| S. NO. | PROPERTY | ASTM/IP METHOD | RESULT |
|---|---|---|---|
| 1. | PENETRATION AT 25° C. AFTER 60 STROKES | D-217 | 295 |
| 2. | DROP POINT °C. | D-2265 | 296 |
| 3. | COPPER CORROSION AT 100° C., 24 HRS | IP 112 | PASS |
| 4. | WATER WASHOUT % Wt | D-1264 | 2.0 |

This alternate process for making lubricating grease has shown enhanced drop point, good shear stability, good corrosion resistance and improved water resistance properties.

EXAMPLE NO. 6

The lubricating grease composition has been prepared consisting the ingredients with the proportions indicated below.

The lubricating grease composition consists of 11.3% of titanium isopropoxide, 6.6% of teraphthalic acid, 11.3% of oleic acid, the remainder being mineral base oil and water.

The composition prepared as per example No. 2 has the following characteristics as shown in Table-7.

TABLE NO. 7

| S. NO. | PROPERTY | ASTM/IP METHOD | RESULT |
|---|---|---|---|
| 1. | PENETRATION AT 25° C. | D-217 | 139 |

TABLE NO. 7-continued

| S. NO. | PROPERTY | ASTM/IP METHOD | RESULT |
|---|---|---|---|
| | AFTER 60 STROKES | | |
| 2. | DROP POINT °C. | D-556 | 248 |
| 3. | COPPER CORROSION AT 100 C. 24 HRS | IP 112 | PASS |
| 4. | WATER WASHOUT % Wt. | D-1264 | 2.0 |

The effectiveness of the lubricating grease with oleic acid in place of stearic acid has shown good thickening capacity and shear stability while maintaining high drop point, good water resistance and good corrosion resistance characteristics.

We claim:

1. A lubricating grease composition comprising 2 to 20% by weight of titanium alkoxide, 2 to 20% by weight of carboxylic acids other than fatty acids, 5.0 to 35.0% by weight of fatty acids, 0.0 to 5.0% by weight of water and 20 to 90% by weight of an oil selected from the group consisting of mineral and synthetic oils.

2. A lubricating grease composition as claimed in claim 1 wherein the said oil is an oligomer of olefin selected from the group consisting of polyalpha olefin, polybutene and polyethers, said carboxylic acids selected from the group consisting of acetic acid, b.v.c. acid, oxalic acid, malonic acid, succinic acid, glutaric acid, azelic acid, sebacic acid, tartaric acid, citric acid, benzoic acid, salicylic acid, phthalic acid, terephthalic acid, fumaric acid, maleic acid and cinnamic acid, said fatty acids being selected from the group consisting of oleic acid and stearic acid.

3. A lubricating grease composition as claimed in claim 1, wherein the alkoxide is titanium alkoxide of C3 to C6 alcohol having titanium metal content of approimately 17% by weight.

4. A lubricating grease composition as claimed in claim 1 where fatty acid is mahuaw oil.

5. A process for the preparation of a lubricating grease composition which comprises by forming in a first stage a mix by adding together fatty acid, carboxylic acid other than fatty acid and mineral or synthetic oil, stirring and heating such a mix to a temperature of 70° to 100° C., adding in a second stage titanium dioxide while maintaining said temperature, raising the temperature to 100° to 200° C. to form a thickened grease product, cooling said product and in a third stage optionally adding water thereto and then subjecting the mixture to the step of shearing.

6. A process as claimed in claim 5 wherein 2 to 20% of titanium alkoxide is added.

7. A process as claimed in claim 5 wherein the mixture in the first stage is continuously mixed and held at 70°–100° C. for 1–2 hours and in the second stage at a temperature of 100° to 200° C. for a period of 2 to 8 hours.

8. A process as claimed in claim 5 wherein the mix is cooled with continuous stirring to 140°–100° C. and 0–5% by wt. of water is added.

9. A process for the preparation of a lubricating grease composition, comprising preparing in a first stage a mix by adding together fatty acid, carboxylic acid other than fatty acid, titanium alkoxide and mineral or synthetic oil in required proportions, heating such a mixture to a temperature of 160° to 200° C., cooling the resultant mix and in a second stage adding required water thereto, stirring the cooled mix and then further cooling said mix and subjecting it to a step of shearing.

10. A process as claim in claim 9 wherein said mixture is cooled to a temperature of 140° to 80° C. in 2 to 8 hours.

* * * * *

UNITED STATES PATENT AND TRADEMARK OFFICE

CERTIFICATE OF CORRECTION

PATENT NO. : 5,387,351

DATED : February 7, 1995

INVENTOR(S) : KUMAR et al

It is certified that error appears in the above-indentified patent and that said Letters Patent is hereby corrected as shown below:

Col. 8, lines 1 and 2 (Claim 3, lines 3 and 4) "approi-mately" should be --approximately--.

Signed and Sealed this

Sixth Day of June, 1995

*Attest:*

Bruce Lehman

BRUCE LEHMAN

*Attesting Officer*

*Commissioner of Patents and Trademarks*